US007665528B2

(12) United States Patent
Ross et al.

(10) Patent No.: US 7,665,528 B2
(45) Date of Patent: Feb. 23, 2010

(54) FRANGIBLE FLAPPER VALVE WITH HYDRAULIC IMPACT SLEEVE AND METHOD OF BREAKING

(75) Inventors: Richard J. Ross, Houston, TX (US); Russell LaFargue, Humble, TX (US)

(73) Assignee: BJ Services Company, Houston, TX (US)

( * ) Notice: Subject to any disclaimer, the term of this patent is extended or adjusted under 35 U.S.C. 154(b) by 148 days.

(21) Appl. No.: 11/879,182

(22) Filed: Jul. 16, 2007

(65) Prior Publication Data

US 2009/0020290 A1 Jan. 22, 2009

(51) Int. Cl.

| | |
|---|---|
| ***E21B 33/00*** | (2006.01) |
| ***E21B 33/12*** | (2006.01) |
| ***E21B 34/00*** | (2006.01) |
| ***E21B 34/06*** | (2006.01) |

(52) U.S. Cl. ..... 166/373; 166/317; 166/386

(58) Field of Classification Search ..... 166/376, 166/317

See application file for complete search history.

(56) References Cited

U.S. PATENT DOCUMENTS

| | | | | |
|---|---|---|---|---|
| 5,188,182 | A * | 2/1993 | Echols et al. | 166/376 |
| 7,287,596 | B2 * | 10/2007 | Frazier et al. | 166/332.8 |
| 2002/0070028 | A1 * | 6/2002 | Garcia et al. | 166/373 |

* cited by examiner

*Primary Examiner*—David J Bagnell
*Assistant Examiner*—Catherine Loikith
(74) *Attorney, Agent, or Firm*—Howrey LLP

(57) ABSTRACT

A frangible flapper valve that may be closed to hydraulically isolate a portion of a wellbore tubular. The flapper valve is made of a frangible material adapted to shatter upon impact from an impact sleeve. The sleeve may be used to initially hold open the flapper valve. A latching mechanism may be used to retain the sleeve above its initial position allowing the flapper to close isolating a portion of the tubular. The latching mechanism may engage a piston to retain the sleeve at the second position. A shearable device adapted to shear under a predetermined pressure selectively connects the piston to the tubular. When the pressure within the tubular increases above the predetermined amount the shearable device releases the piston and pushes the sleeve into the closed flapper valve causing the flapper valve to shatter. A second latching mechanism may prevent further movement of the sleeve.

10 Claims, 7 Drawing Sheets

FRANGIBLE FLAPPER VALVE WITH HYDRAULIC IMPACT SLEEVE AND METHOD OF BREAKING

BACKGROUND OF THE INVENTION

1. Field of the Invention

The present invention generally relates to a flapper valve that may be used to hydraulically isolate a portion of a wellbore tubular, the flapper valve being made of a frangible material that may be broken with a hydraulic impact sleeve. The flapper is movable from an open position and a closed position and may be biased to the closed position. The flapper is comprised of a frangible material, such as ceramic, that is adapted to shatter upon impact by an impact sleeve. The pressure within the tubular above the closed flapper may encourage the flapper to shatter once a crack is made in the flapper valve by the impact sleeve.

The impact sleeve may be used to initially hold open the flapper valve allowing fluid flow through the wellbore tubular. When it is desired to hydraulically isolate a portion of the wellbore tubular, the impact sleeve may be moved up the wellbore tubular to a second position allowing the flapper valve to close. A latching mechanism may be used to selectively retain the impact sleeve at the second position. For example, the impact sleeve may be connected to a collet located within the wellbore tubular. A mandrel may be inserted within the collet and may be used to raise the collet and the sleeve up the tubular to the second position. In the second position, the sleeve may be located adjacent a piston that is releasably connected to the wellbore tubular. A shearable device, such as a shear screw, may be used to releasably connect the piston to the tubular. The shearable device permits the release of the piston when the pressure within the tubular is increased to a predetermined amount.

After using the mandrel to move the sleeve to the second position, the collet may be deformed to release the mandrel. The piston may be used to hold the collet and/or the impact sleeve at the second position until it is desired to break the frangible flapper valve. The pressure within the tubular may be increased to the amount required to shear the shearable device, thus releasing the piston. The elevated pressure within the wellbore drives the piston and thus, the impact sleeve downwards towards the closed flapper valve. The impact of the sleeve against the flapper valve causes the flapper valve to shatter within the wellbore tubular. The lower end of the impact sleeve may be adapted to promote the shattering of the frangible flapper valve. Further, the lower end of the impact sleeve may be adapted to impact the frangible flapper valve about its outer edge. A second latching mechanism may be used to retain the piston and/or impact sleeve at a position within the wellbore after the frangible flapper valve has been shattered.

2. Description of the Related Art

There are a various number of sealing elements and/or valves that have been used in the oil and gas industry to isolate a portion of a wellbore tubular. Flapper valves are often a preferred sealing means because flapper type valves generally require less radial space than other commercially available valves and/or sealing means. Flapper valves are generally biased, by a spring or other resilient member, to close and hydraulically isolate a portion of the tubular when the flapper is not being held open. Prior to being closed, a mandrel or sleeve is often inserted through the flapper valve to hold open the valve. The mandrel or sleeve is then removed when it is necessary to isolate a portion of the wellbore below the flapper valve.

The closed flapper may cause a high pressure differential to be created on the opposite sides of the closed flapper making it difficult to reopen. Further, it may be difficult to grab a hold of the flapper with a tool to reopen the valve. Other flapper valves have been designed to be operated hydraulically, which increases the complexity of the valve. In order to overcome the difficulties of opening a closed flapper valve, a number of prior flapper valves have been designed to break under an elevated pressure within the wellbore tubular. These type flapper valves must be designed to hold an amount of pressure to adequately isolate a portion of the wellbore tubular, but to shatter or break upon the application of an elevated amount of pressure. However, it is difficult to predict when and at what pressure such a flapper will break.

In light of the foregoing, it would be desirable to provide flapper valve that is designed to be shattered by the impact of a sleeve within the wellbore tubular. It would further be desirable to provide a means for releasing the sleeve at a predetermined pressure within the wellbore tubular. The use of a shearable device, such as a shear pin, provides an accurate prediction of when the sleeve will be released within the wellbore shattering the flapper valve. It would be desirable to provide a flapper valve comprised of a frangible material to promote the shattering of the valve upon impact from the sleeve.

The present invention is directed to overcoming, or at least reducing the effects of, one or more of the issues set forth above.

SUMMARY OF THE INVENTION

The object of the present disclosure is to provide a frangible flapper system that may be used to selectively isolate a portion of a wellbore tubular. One embodiment includes a tubular member, a flapper valve rotatably disposed within the tubular member being movable between an open position and a closed position, and an actuation assembly moveably disposed within the tubular member. The actuation assembly is movable between a first position, a second position, and a third position. In the first position, the actuation assembly engages the flapper valve maintaining the flapper in the open position. In the second position, the actuation assembly selectively engages the tubular member and disengages the flapper valve allowing the flapper valve to move to the closed position. In the third position, the actuation assembly at least a component of the actuation assembly contacts the flapper valve in the closed position so as to fracture the flapper valve.

One embodiment is a flapper valve system that includes a flapper valve of a frangible material, such as ceramic, that is movable between an open position and a closed position that hydraulically isolates a portion of a wellbore tubular. The flapper valve may include biasing means to bias the flapper valve to its closed position. The biasing means may be one of various means, such as a spring or resilient member, causing the flapper valve to close, if unobstructed, as would be appreciated by one of ordinary skill in the art having the benefit of this disclosure.

The system includes an impact sleeve that may be moved from a first position that prevents the closure of the flapper valve to a second position that allows the flapper valve to close. The system includes a latching mechanism that may be used to selectively retain the impact sleeve at the second position. The latching mechanism may be various latching mechanisms such as collets, snap rings, or spring loaded dogs as would be appreciated by one of ordinary skill in the art having the benefit of this disclosure.

In one embodiment the system includes a first latching mechanism connected to an upper end of the impact sleeve. The first latching mechanism is movable from a first position to a second position within the wellbore tubular. In the first position, the lower end of the impact sleeve holds the flapper valve open while in the second position the lower end of the impact sleeve is moved up the tubular permitting the flapper valve to close. The system includes a piston that is releasably connected to the tubular by a shearable device. The shearable device may be any device, such as a shear pin, that releases the piston when the pressure within the tubular reaches a predetermined amount. The piston may be used to retain the first latching mechanism and the impact sleeve at the second position. The piston may be positioned adjacent to a shoulder of the impact sleeve. Alternatively, the piston may be designed to engage a portion of the impact sleeve such that the sleeve moves when the piston moves down the wellbore tubular. Various means may be used to engage the piston with the impact sleeve as would be appreciated by one of ordinary skill in the art having the benefit of this disclosure. Once it is no longer desired to isolate a portion of the wellbore tubular, the pressure within the tubular is increased until the shearable device releases the piston from the wellbore tubular. The pressure within the tubular drives the impact sleeve into the closed flapper valve breaking or shattering the frangible flapper valve.

The system may include a hydraulic port through the wellbore tubular that may be used to provide back pressure to the piston. The lower end of the impact sleeve may include a tab adapted to hold open the flapper valve when the sleeve is in its initial position. The lower end of the sleeve may be adapted, such as including a point, to promote the shattering of the flapper valve upon impact. Further, the lower end of the impact sleeve may be adapted to impact the closed flapper valve along its outer edge. The flapper valve of the system is adapted to be able to withstand pressure within the wellbore tubular that is above the predetermined pressure required to shear the shearable device. The system may include a secondary latching mechanism to prevent further movement of the sleeve and/or piston after the closed flapped valve has been broken.

One embodiment is a method for selectively hydraulically isolating a portion of a wellbore tubular including the steps of providing a flapper valve within a wellbore tubular, the flapper valve including a biasing mechanism to move the flapper to a closed position that hydraulically isolates the portion of the wellbore tubular and connecting a sleeve to a latching mechanism, such as a collet, within the wellbore tubular. The latching mechanism may be positioned on a mandrel that is adapted to move the latching mechanism from a first position to a second position within the tubular. The method includes initially holding open the flapper valve with the sleeve when the latching mechanism is in the first position and moving the mandrel up the wellbore tubular to a second position that allows the flapper valve to close. The method includes engaging the latching mechanism to a piston that is releasably connected to the wellbore tubular. The piston is releasably connected to the wellbore tubular by a shearable device adapted to shear or release at a predetermined amount of pressure within the tubular. The method may include the step of deforming the latching mechanism to release the mandrel. The method includes increasing the pressure within the wellbore tubular to the predetermined amount releasing the piston. The method includes the pressure moving the sleeve down the wellbore tubular to break the flapper valve.

The method may include engaging the sleeve with a second latching mechanism after breaking the flapper valve. The latching mechanism may be one of various devices such as a locking dog or snap ring as would be appreciated by one of ordinary skill in the art having the benefit of this disclosure. The method may include a step of pumping hydraulic pressure into a hydraulic port in the wellbore tubular to back pressure the piston. The valve may be comprised of a frangible material to promote its shattering upon impact by the sleeve. The sleeve may be adapted to impact along the edge of the closed flapper valve.

One embodiment is a method for selectively isolating a portion of a wellbore tubular that includes holding open a flapper valve with a sleeve positioned within a wellbore tubular and moving the sleeve up the wellbore tubular such that the flapper valve closes to hydraulically isolate a portion of the wellbore tubular. The method includes securing the sleeve at the second position. The sleeve is secured at the second position by a shearable device adapted to shear under a predetermined amount of pressure within the tubular. The method includes the step of increasing the pressure within the wellbore tubular to the predetermined amount. At this amount, the shearable device shears releases the sleeve from the second position breaking the flapper valve.

One embodiment is a system for selectively breaking a closed flapper valve including a flapper valve of a frangible material that is adapted to be movable from an open position to a closed position. The system includes a sleeve that has an initial position that holds the flapper valve open and a second position above the flapper valve that permits the flapper valve to close. The system includes means for moving the sleeve to the second position. The means for moving the sleeve may be a collet connected to the sleeve and a mandrel used to move the collet. The means for moving the sleeve to the second position may be varied within the spirit of the invention as would be appreciated by one of ordinary skill in the art having the benefit of this disclosure.

The system also includes means for selectively retaining the sleeve in the second position until a predetermined pressure is applied. Upon application of the predetermined pressure, the sleeve is released breaking the closed flapper valve. The means for selectively retaining the sleeve may include a shear pin, a shear screw, or any such device that is adapted to shear or release under a predetermined amount of pressure as would be appreciated by one of ordinary skill in the art having the benefit of this disclosure.

One embodiment is a system for selectively hydraulically isolating a portion of a wellbore tubular including a flapper valve comprised of a frangible material that may be moved between an open position to a closed position and a spring that biases the flapper valve to the closed position. The system also includes a sleeve having an upper end and a lower end, the sleeve being movable from a first position to a second position. In the first position the lower end of the sleeve is positioned to hold open the flapper valve and in the second position the lower end of the sleeve permits the flapper valve to close. The system includes a piston releasably connected to the wellbore tubular by at least one shearable device. A portion of the piston engages a portion of the sleeve when the sleeve is in its second position. The at least one shearable device shears when the pressure within the tubular reaches a predetermined amount thus releasing the piston. Upon being released, the piston forces the sleeve down the wellbore tubular until the lower end of the sleeve breaks the closed flapper valve.

Figure 1:
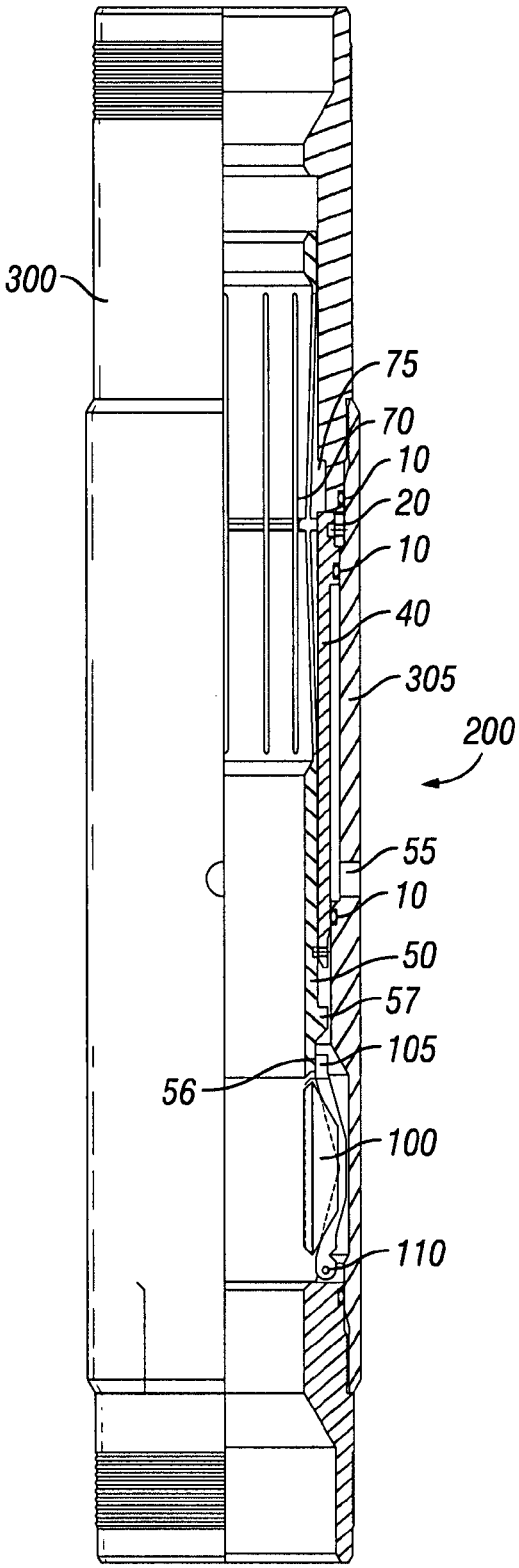
FIG. 1 shows a partial cross-section of one embodiment of a frangible flapper valve system within a wellbore tubular, the frangible flapper valve initially being held open with an impact sleeve.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in a system and method that uses a frangible flapper valve to isolate a portion of a wellbore tubular and a hydraulic impact sleeve used to break the closed frangible flapper valve. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments of the invention will become apparent from consideration of the following description and drawings.

FIG. 1 shows a partial cross-section of one embodiment of a frangible flapper valve system 200 within a wellbore tubular 300, the frangible flapper valve 100 initially being held open with a movable sleeve 50. The flapper valve 100 is comprised of a frangible material, such as ceramic, that is adapted to shatter upon impact from the sleeve 50. The flapper may be comprised of any frangible material that may be used to hold against pressure within a tubular, but that will shatter upon impact from a sleeve as would be appreciated by one of ordinary skill in the art having the benefit of this disclosure.

The flapper valve 100 is rotatable about a hinge 110 to move the flapper 100 between an open position and a closed position. In the closed position the flapper valve 100 hydraulically isolates a portion of a wellbore tubular 300. The flapper valve 100 may include biasing means to bias the flapper valve to its closed position. The biasing means may be one of various means, such as a spring or resilient member, causing the flapper valve to close, if unobstructed, as would be appreciated by one of ordinary skill in the art having the benefit of this disclosure.

Figure 2:
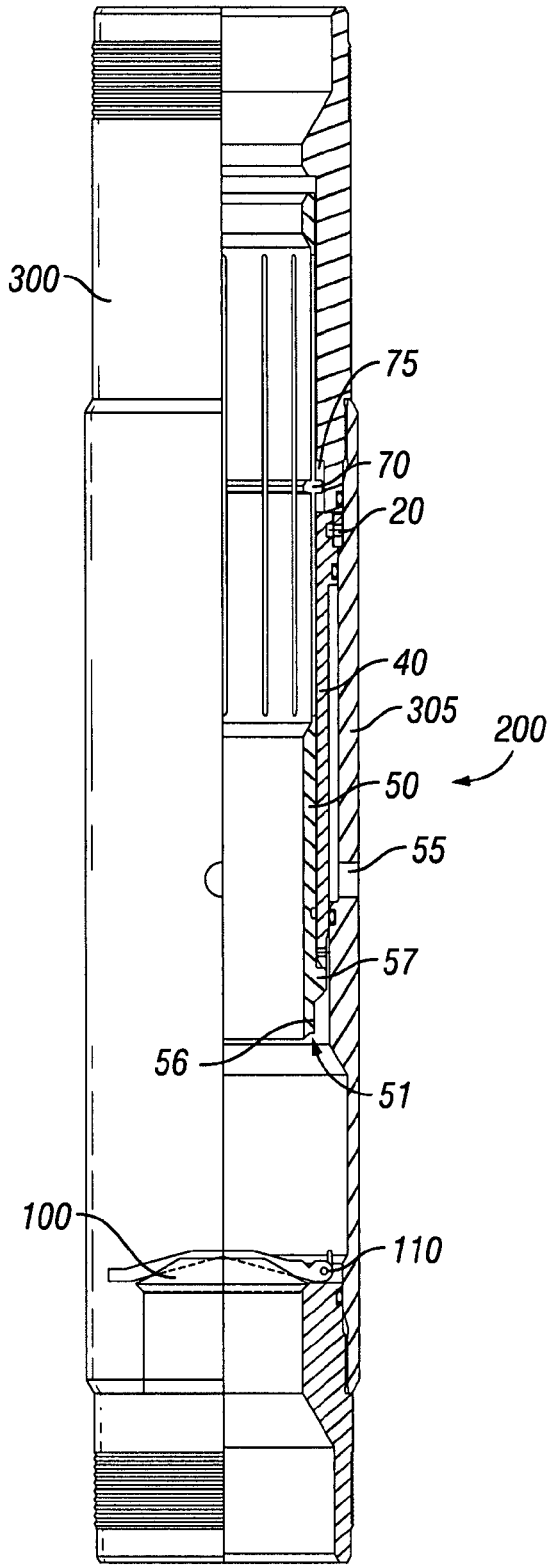
FIG. 2 shows a partial cross-section of the embodiment of FIG. 1 with the impact sleeve moved above the frangible flapper valve allowing the flapper valve to close hydraulically isolating a portion of the wellbore tubular.

The frangible flapper valve system 200 includes a collet 70 connected to an upper end of the sleeve 50. The collet 70 is movable from a first position to a second position within the wellbore tubular 300. In the first position, the lower end 56 of the sleeve 50 holds the flapper valve 100 open within the tubular 300. The flapper valve 100 may include a tab 105 that engages the lower end 56 of the sleeve 50 while the sleeve 50 is in its first position. As shown in FIG. 2, when the sleeve 50 is moved up the tubular 300 to the second position the end of the sleeve 56 permits the flapper valve 100 to close, hydraulically isolating a portion of the tubular 300.

The frangible flapper valve system 200 includes a piston 40 that is releasably connected to the tubular 300 by a shearable device 20. The shearable device 20 may be any device, such as a shear pin, that releases the piston 40 when the pressure within the tubular 300 reaches a predetermined amount. The piston 40 may be used to retain the collet 70 and the sleeve 50 at the second position within the tubular 300. For example, the upper end of the piston 40 may create a cavity 75 within the tubular 300 into which a portion of the collet 70 expands thus retaining the collet 70 and sleeve 50 in the second position until the piston 40 is released from the tubular 300. The use of a deformable collet 70 is for illustrative purposes only as a number of devices, such as a locking dog or a secondary hydraulic mechanism, could be used to retain the sleeve 50 in its second position as would be appreciated by one of ordinary skill in the art having the benefit of this disclosure.

Figure 3:
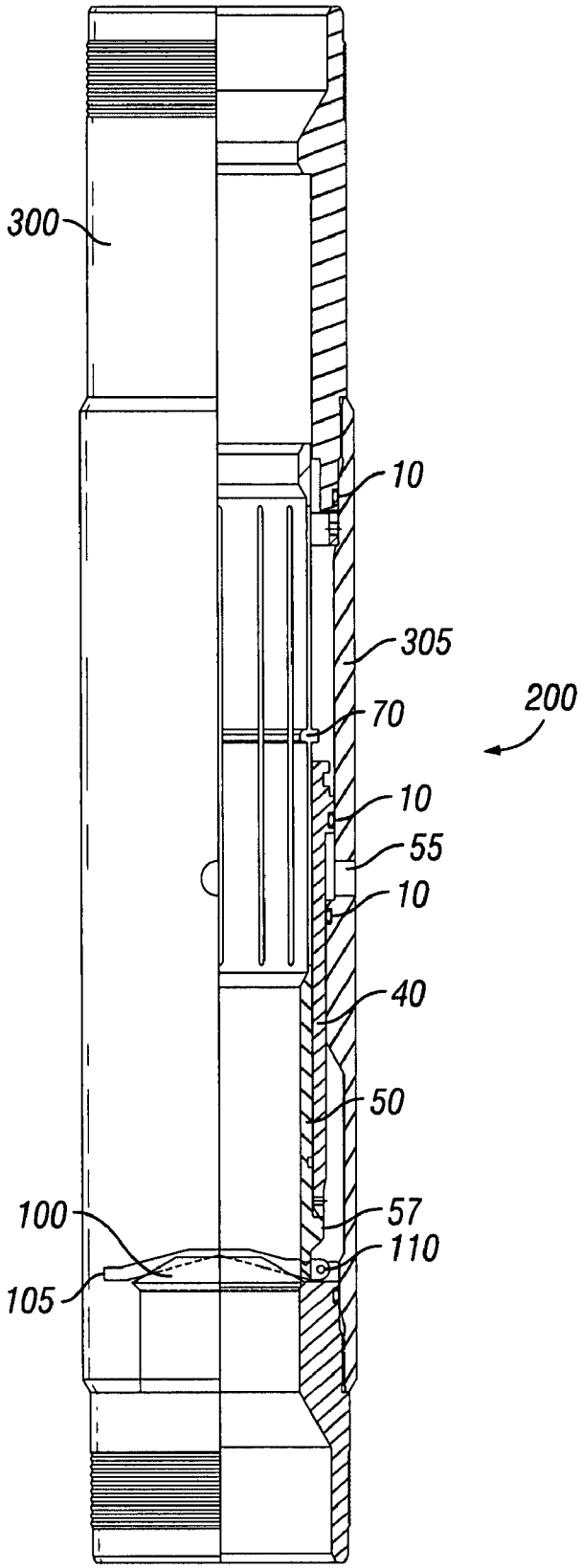
FIG. 3 shows a partial cross-section of the embodiment of FIG. 1 with the impact sleeve impacting the frangible flapper valve.
Figure 4:
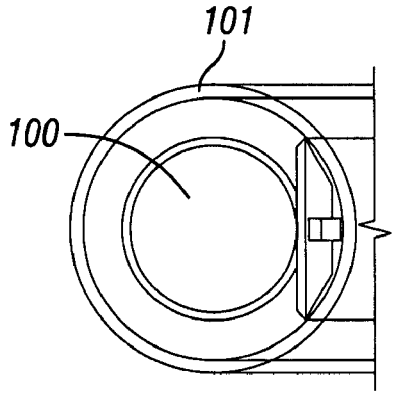
FIG. 4 shows a top view of one embodiment of a frangible flapper valve that may be used in a wellbore tubular.

The piston 40 may be positioned adjacent to a shoulder 57 of the sleeve 50 when the sleeve 50 is in its second position. Alternatively, the piston 40 may be designed to engage a portion of the sleeve 50 such that the sleeve 50 will move down the tubular 300 with the piston 40 after the piston 40 is released from the tubular 300. Various means may be used to engage the sleeve 50 with the piston 40 as would be appreciated by one of ordinary skill in the art having the benefit of this disclosure. Once it is no longer necessary to hydraulically isolate a portion of the wellbore tubular 300, the pressure within the tubular 300 is increased to the predetermined amount necessary to release the piston 40 from the wellbore tubular 300. The shearable device 20 is designed to release the piston 40 under a predetermined amount of pressure. After the release of the piston 40, the pressure within the tubular 300 drives the piston 40 down the wellbore tubular 300. The piston 40, which is engaged with the impact sleeve 50, drives the impact sleeve 50 into the closed flapper valve 100 as shown in FIG. 3. The flapper valve 100 is made of a frangible material to promote the breaking or shattering of the flapper valve 100 upon the impact of the sleeve 50. The lower end 56 of the sleeve 50 may include a bottom surface 51 adapted to promote the breaking of the flapper valve 100.

The frangible flapper system 200 may include a hydraulic port 55 through an outer wall 305 that may be used to provide back pressure to the piston 40. The system may include sealing elements 10 to seal the interface between the piston 40 and the outer wall 305. The lower end 56 of the sleeve 50 may be adapted to contact the closed flapper valve 100 along its outer edge 101. The use of a shearable device in combination with an impact sleeve provides a disclosed flapper valve system that can effectively remove a closed flapper from a wellbore tubular at a predetermined pressure within the tubular.

A mandrel may be inserted into the collet 70 to move the collet 70 up the wellbore tubular 300 from a first position to a second position. In the first position, the sleeve 50 attached to the collet 70 holds open the flapper valve 100. At the second position, the collet 70 may be deformed to engage a portion of the piston 40 and release the mandrel. The piston may be used to retain the collet 70 and the sleeve 50 in the second position until it is desired to break the closed flapper valve 100. As discussed above, the piston is releasably connected to the wellbore tubular by a shearable device adapted to shear or release at a predetermined amount of pressure within the tubular. Upon release of the piston 40, the sleeve 50 is driven into the closed flapper valve 100 to break the flapper valve 100. Alternatively, one embodiment may include a sleeve that may be moved by itself from a first position holding open a flapper valve to a second position allowing the flapper valve to close. A selectively releasable device may be used to retain the sleeve at the second position with a wellbore tubular until it was desired to break the closed flapper valve.

Figure 5:
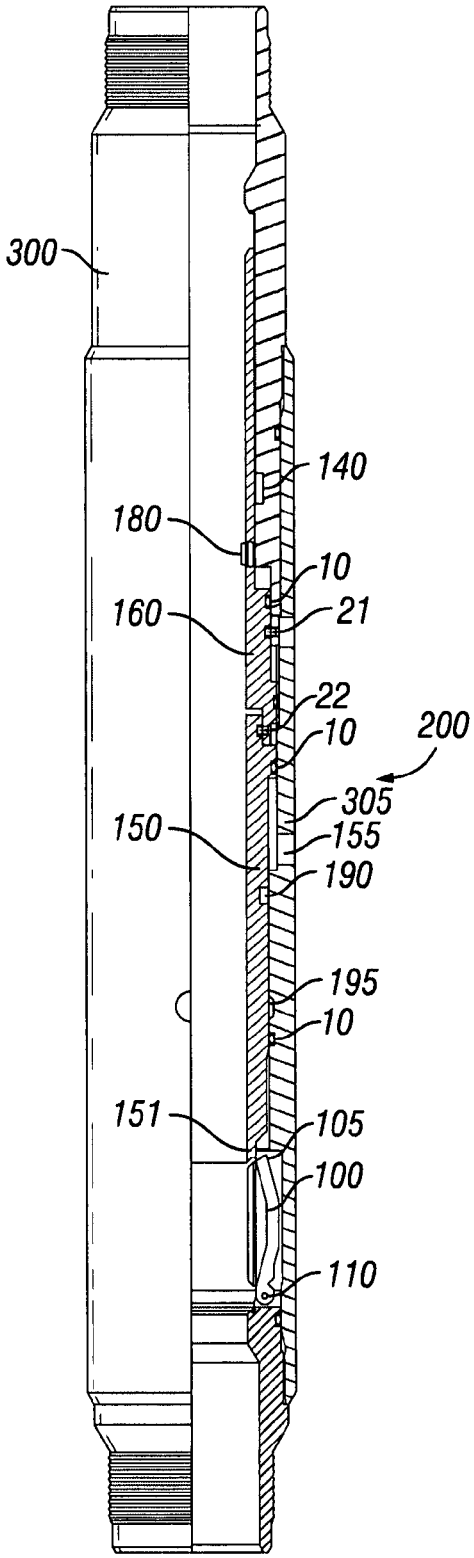
FIG. 5 shows a partial cross-section of one embodiment of a frangible flapper valve system within a wellbore tubular that uses a lower piston selectively connected to an upper piston.

FIG. 5 shows a partial cross-section of one embodiment of a frangible flapper valve system 200 within a wellbore tubular 300, the frangible flapper valve 100 initially being held open with a lower piston 150. As discussed above, the flapper valve 100 is comprised of a frangible material, such as ceramic, that is adapted to shatter upon impact from the lower piston 150. The flapper valve 100 is rotatable about a hinge 110 to move the flapper 100 between an open position and a closed position. In the closed position the flapper valve 100 hydraulically isolates a portion of a wellbore tubular 300. The flapper valve 100 may include biasing means to bias the flapper valve to its closed position.

The frangible flapper valve system 200 includes an upper piston 160 selectively connected to the lower piston 150 by a shearable device 22, such as a shear pin. The upper piston 160 is movable from a first position to a second position within the wellbore tubular 300. In the first position, the upper piston 160 is held in place within the tubular 300 by a shearable device 21. While the upper piston 160 is in the lower position, the lower end 151 of the lower piston 150 holds the flapper valve 100 open within the tubular 300. The flapper valve 100 may include a tab 105 that engages the lower end of the lower piston 150.

A locking dog 180 may be connected to the upper piston 160 as shown in FIG. 5. A tool may grab the locking dog 180 to pull the upper piston 160 to a second position within the wellbore tubular 300. At the second position, the locking dog 180 may expand into a recess 140 in the tubular 300 locking the upper piston 160 in its second position. Prior to moving the upper piston 160 to its second position, a force is applied to locking dog 180 that is sufficient to shear the shearable device 21 allowing the upper piston 160 and the lower piston 150 to move up the wellbore tubular 300. The movement of the lower piston 150 up the wellbore tubular 300 allows the flapper 100 to close hydraulically isolating a portion of the wellbore tubular 300.

Once it is no longer necessary to hydraulically isolate a portion of the wellbore tubular 300, the pressure within the tubular 300 is increased to a predetermined amount necessary to shear the shearable device 22 releasing the lower piston 150 from the upper piston 160 within the wellbore tubular 300. The shearable device 22 is designed to release the lower piston 150 at a predetermined amount of pressure. After the release of the lower piston 150, the pressure within the wellbore tubular 300 drives the lower piston 150 down the wellbore tubular 300 and into the closed flapper valve 100. As discussed above, the flapper valve 100 is made of a frangible material to promote the breaking or shattering of the flapper valve 100 upon the impact of the piston 150. The lower end 151 of the lower piston 150 may include a bottom surface adapted to promote the breaking of the flapper valve 100.

The frangible flapper system 200 may include a hydraulic port 155 through the wellbore tubular 300 that may be used to provide back pressure to the lower piston 150. The lower end 151 of the lower piston 150 may be adapted to contact the closed flapper valve 100 along its thin outer edge. The outer wall 305 of the frangible flapper system 200 may include a recess 195 into which a secondary locking dog 190 located on the lower piston 150 may expand. The secondary locking dog 190 may be used to prevent further movement of the lower piston 150 after breaking the flapper valve 100.

Figure 6:
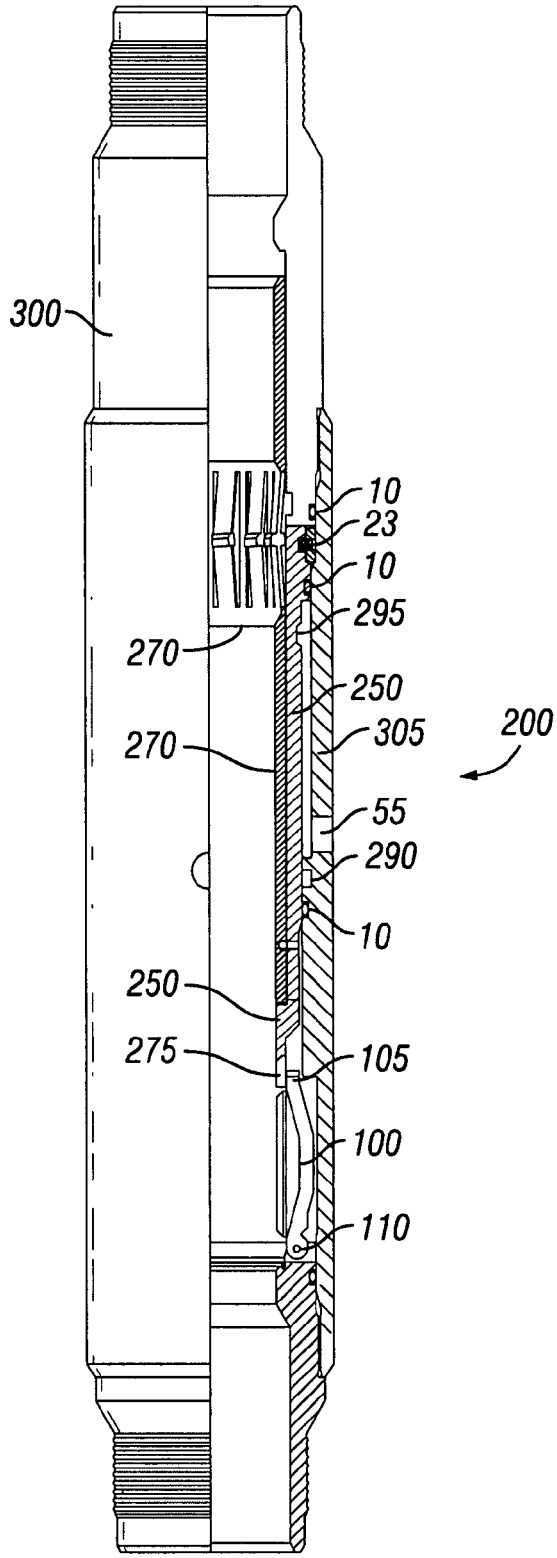
FIG. 6 shows a partial cross-section of one embodiment of a frangible flapper valve system within a wellbore tubular that includes a collet and a piston, a finger of a collet holds open the flapper and the piston is used to selectively break the closed flapper valve.
Figure 8:
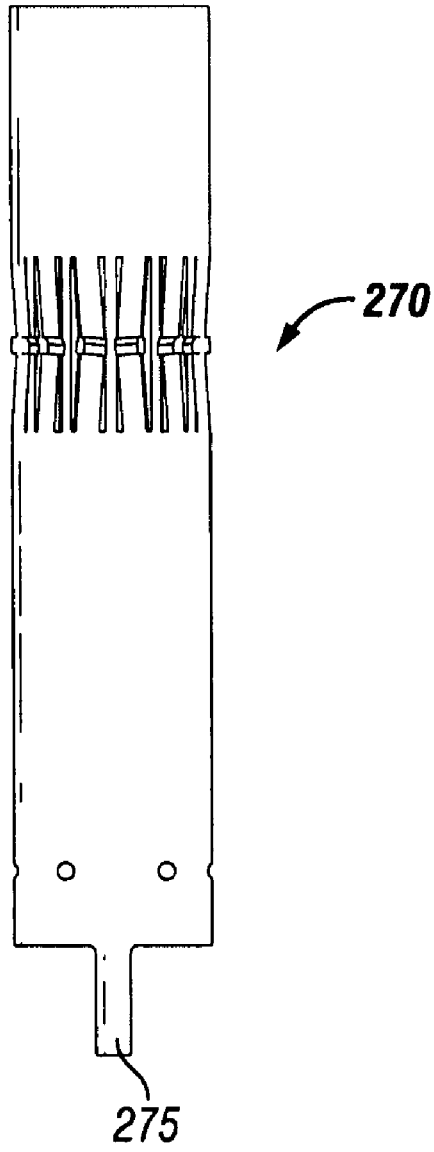
FIG. 8 shows a collet having a finger that may be used in the embodiment shown in FIG. 6.

FIG. 6 shows a partial cross-section of one embodiment of a frangible flapper valve system 200 within a wellbore tubular 300, the frangible flapper valve 100 initially being held open with a finger 275 of a movable collet 270. FIG. 8 shows a perspective view of one embodiment of a collet 270 having a finger 275. The collet 270 is movable from a first position to a second position within the wellbore tubular 300. In the first position, the finger 275 of the collet 270 extends through a slot 255 of a piston 250 such that the finger holds open the frangible flapper valve 100. The flapper valve 100 may include a tab 105 that engages the finger 275 of the collet 270. When the collet 270 is moved up the tubular 300 to the second position the finger 275 releases the flapper valve 100 allowing it to close and hydraulically isolate a portion of the tubular 300. A portion of the collet 270 may expand into a recess within the tubular 300 thus retaining the collet 270 at the second position within the tubular 300.

Figure 7:
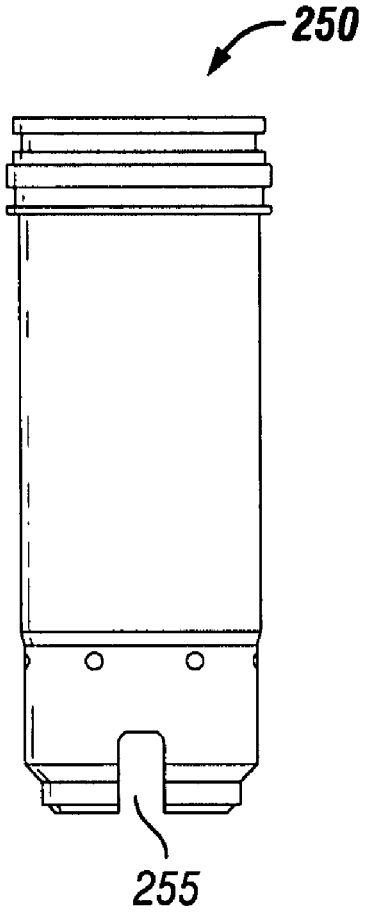
FIG. 7 shows a piston that may be used in the embodiment shown in FIG. 6.

The piston 250 is selectively connected to the wellbore tubular 300 by a shearable device 23, such as a shear pin. FIG. 7 shows a perspective view of one embodiment of a piston 250 having a slot 255 through which a finger of a collet may extend. The piston 250 remains in the same position within the wellbore as the collet 270 moves from its first position to its second position up the wellbore tubular 300. At the second position, the finger 275 of the collet 270 allows the frangible flapper valve 100 to close and hydraulically isolate a portion of the wellbore tubular 300. Once it is no longer necessary to hydraulically isolate a portion of the wellbore tubular 300, the pressure within the tubular 300 is increased to a predetermined amount necessary to shear the shearable device 23 releasing the piston 250 within the wellbore tubular 300. The pressure within the wellbore tubular 300 drives the piston 250 down the wellbore tubular 300 and into the closed flapper valve 100. As discussed above, the flapper valve 100 is made of a frangible material to promote the breaking or shattering of the flapper valve 100 upon the impact of the piston 250.

The outer wall 305 of the frangible flapper system 200 may include a secondary locking dog 290 to prevent movement of the piston 250 after breaking the flapper valve 100. The secondary locking dog 290 remains retracted by the piston 250 while the piston 250 travels down the wellbore tubular 300 to break the flapper valve 100. After breaking the flapper valve 100, the piston 250 continues to travel down the wellbore tubular 300 until the secondary locking dog 290 extends into a recessed area 295 of the piston preventing further movement of the piston 250 within the wellbore tubular 300.

Figure 9:
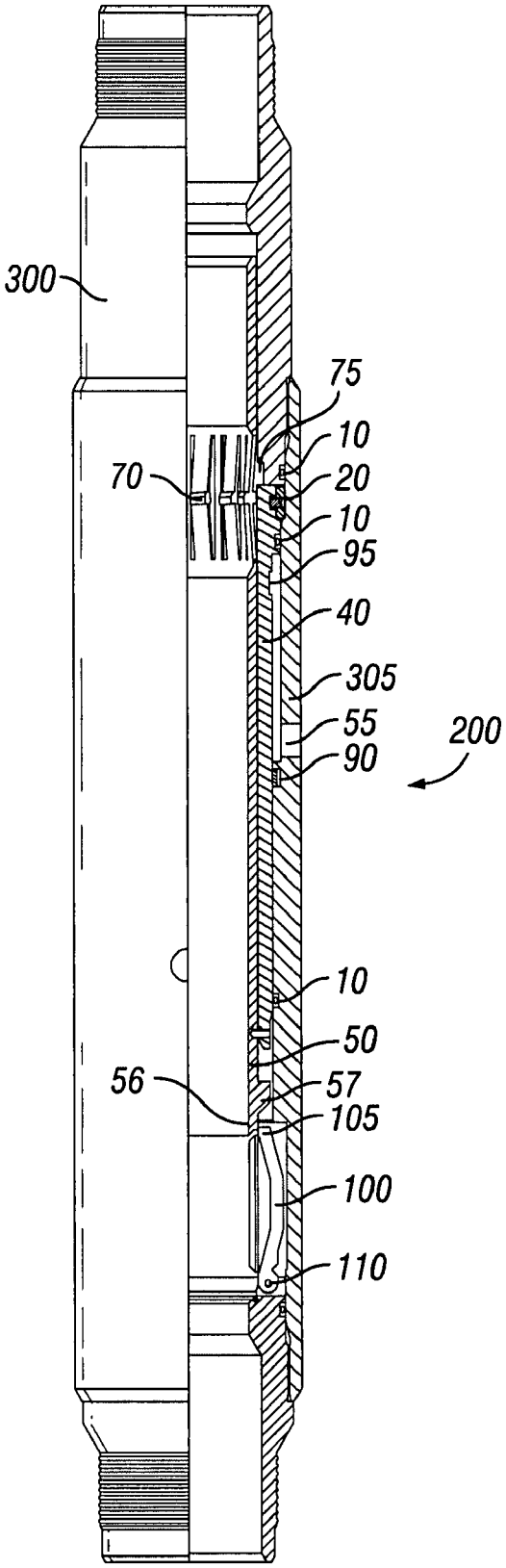
FIG. 9 shows a partial cross-section of one embodiment of a frangible flapper valve system having a secondary latching mechanism, the frangible flapper valve initially being held open with an impact sleeve.
Figure 10:
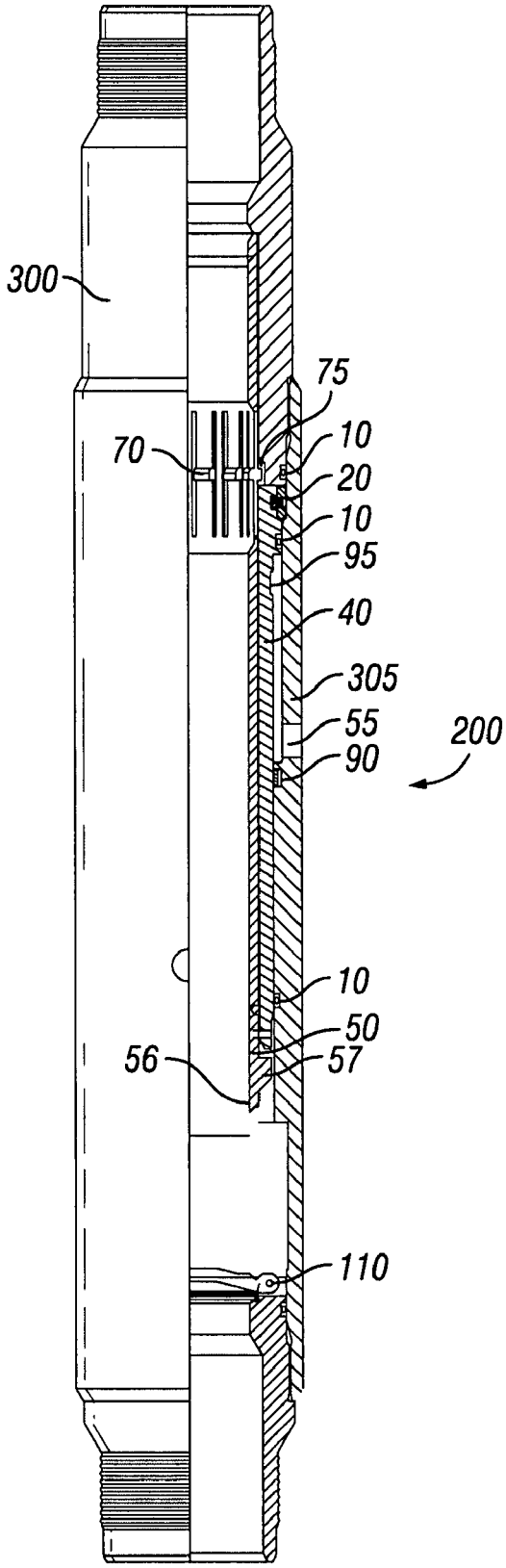
FIG. 10 shows a partial cross-section of the embodiment of FIG. 9 with the impact sleeve moved above the frangible flapper valve allowing the flapper valve to close hydraulically isolating a portion of the wellbore tubular.
Figure 11:
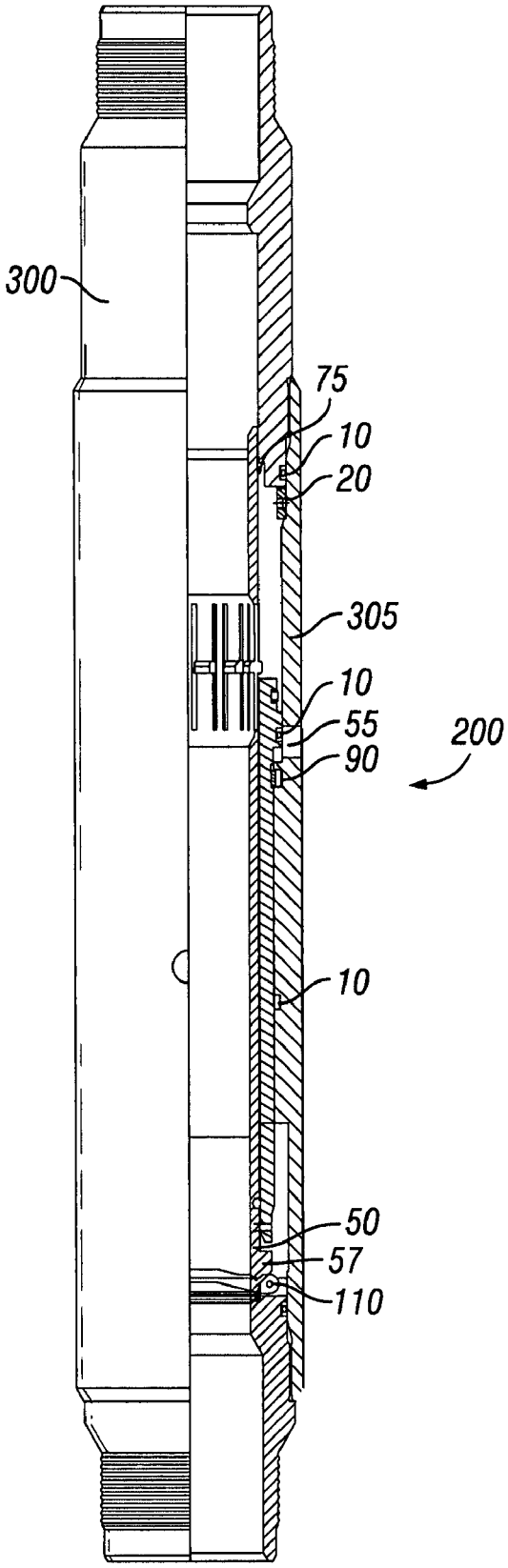
FIG. 11 shows a partial cross-section of the embodiment of FIG. 9 with the impact sleeve impacting the frangible flapper valve.

FIG. 9 shows a partial cross-section of one embodiment of a frangible flapper valve system 200 within a wellbore tubular 300 having a collet 70 as a first latching mechanism and a snap ring 90 as a secondary latching mechanism. FIG. 9 shows the frangible flapper valve 100 being held open in the initial position by a movable sleeve 50. FIG. 10 shows the collet 70 pulled up to a second position moving the sleeve 50 above the flapper valve 100 allowing the flapper valve 100 to close and hydraulically isolate a portion of the wellbore tubular 300. FIG. 11 shows the sleeve 50 impacting the closed flapper valve 100. The snap ring 90 has snapped into a recess 95 of the piston 40 preventing further movement of the piston 40 and sleeve 50 up down the wellbore tubular 300.

Figure 12:
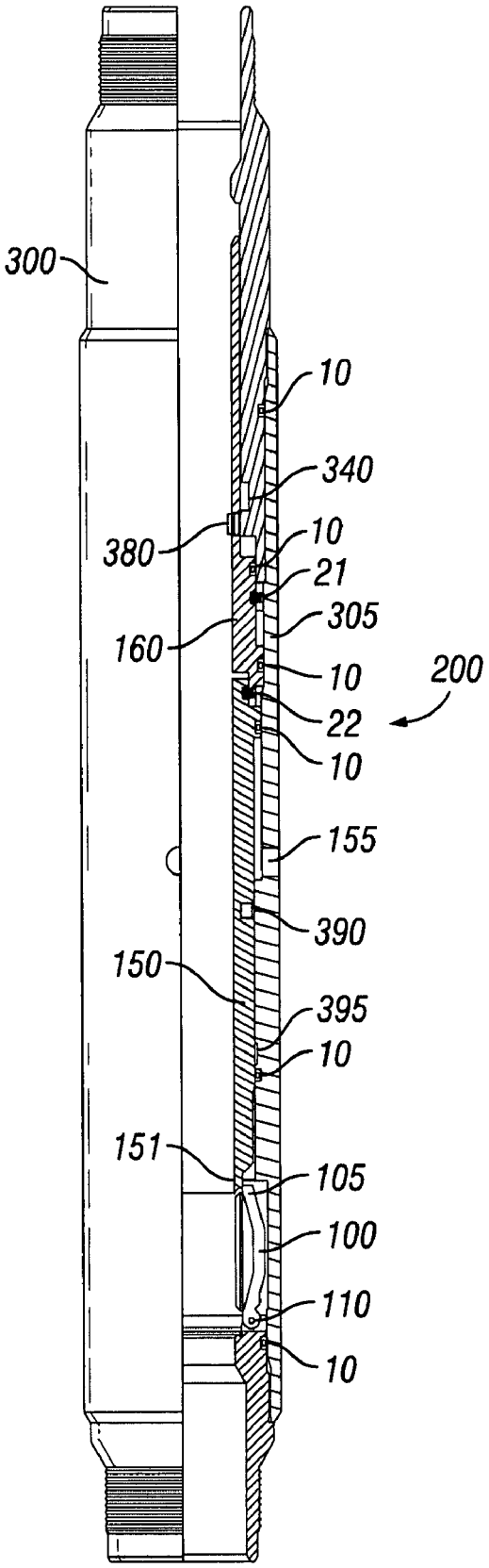
FIG. 12 shows a partial cross-section of one embodiment of a frangible flapper valve system that uses a snap ring as the latching mechanism.

FIG. 12 shows a partial cross-section of one embodiment of a frangible flapper valve system 200 within a wellbore tubular 300, the frangible flapper valve 100 initially being held open with a lower piston 150. As discussed above, the flapper valve 100 is comprised of a frangible material, such as ceramic, that is adapted to shatter upon impact from the lower piston 150. The flapper valve 100 is rotatable about a hinge 110 to move the flapper 100 between an open position and a closed position. In the closed position the flapper valve 100 hydraulically isolates a portion of a wellbore tubular 300. The flapper valve 100 may include biasing means to bias the flapper valve to its closed position.

The frangible flapper valve system 200 includes an upper piston 160 selectively connected to the lower piston 150 by a shearable device 22, such as a shear pin. The upper piston 160 is movable from a first position to a second position within the wellbore tubular 300. In the first position, the upper piston 160 is held in place within the tubular 300 by a shearable device 21. While the upper piston 160 is in the lower position, the lower end 151 of the lower piston 150 holds the flapper valve 100 open within the tubular 300. The flapper valve 100 may include a tab 105 that engages the lower end of the lower piston 150.

A locking dog 380 may be connected to the upper piston 160 as shown in FIG. 12. A tool may grab the locking dog 380 to pull the upper piston 160 to a second position within the wellbore tubular 300. At the second position, the locking dog 380 may expand into a recess 340 in the tubular 300 locking the upper piston 160 in its second position. Prior to moving the upper piston 160 to its second position, a force is applied to locking dog 380 that is sufficient to shear the shearable device 21 allowing the upper piston 160 and the lower piston 150 to move up the wellbore tubular 300. The movement of the lower piston 150 up the wellbore tubular 300 allows the flapper 100 to close hydraulically isolating a portion of the wellbore tubular 300.

Figure 13:
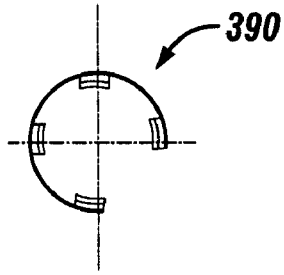
FIG. 13 is a cross-section view of one embodiment of a snap ring that may be used a latching mechanism.

Once it is no longer necessary to hydraulically isolate a portion of the wellbore tubular 300, the pressure within the tubular 300 is increased to a predetermined amount necessary to shear the shearable device 22 releasing the lower piston 150 from the upper piston 160 within the wellbore tubular 300. The shearable device 22 is designed to release the lower piston 150 at a predetermined amount of pressure. After the release of the lower piston 150, the pressure within the wellbore tubular 300 drives the lower piston 150 down the wellbore tubular 300 and into the closed flapper valve 100. The outer wall 305 of the frangible flapper system 200 may include a recess 395 into which a snap ring 390 located on the lower piston 150 may expand. The snap ring 390 may be used to prevent further movement of the lower piston 150 after breaking the flapper valve 100. FIG. 13 shows the cross-section view of one embodiment of a snap ring 390 that may be used as a secondary latching mechanism to prevent further movement of the sleeve and/or piston after the flapper valve has been broken.

Although various embodiments have been shown and described, the invention is not so limited and will be understood to include all such modifications and variations as would be apparent to one skilled in the art.

What is claimed is:

1. A method for selectively isolating a portion of a wellbore tubular, the method comprising:

holding open a flapper valve with a movable device in an initial position;

moving the movable device up the wellbore tubular to a second position, wherein the flapper valve closes to hydraulically isolate a portion of the wellbore tubular;

securing the movable device at the second position;

increasing the pressure within the wellbore tubular to a predetermined amount;

releasing an impact device within the wellbore tubular, wherein the impact device is adapted to be released at the predetermined amount of pressure in response to a downward movement of a piston; and breaking the closed flapper valve with the impact device.

2. The method of claim 1 wherein the impact device is the movable device.

3. The method of claim 1 wherein the impact device is selectively connected to the movable device.

4. The method of claim 1 further comprising securing the impact device to the wellbore tubular after breaking the closed flapper valve.

5. The method of claim 1, wherein the piston moves in response to a shearing of a shearable device adapted to shear under the predetermined amount of pressure.

6. The method of claim 1, wherein the movement of the movable device up the wellbore tubular is accomplished via the use of a latching mechanism.

7. A method for selectively hydraulically isolation a portion of a wellbore tubular, the method comprising providing a flapper valve within the wellbore tubular, the flapper valve including a biasing mechanism to move the flapper valve to a closed position that hydraulically isolates a portion of the wellbore tubular;

connecting a sleeve to a latching mechanism within the wellbore tubular, the latching mechanism being movable from a first position to a second position;

holding open the flapper valve with the sleeve when the latching mechanism is in the first position;

moving the latching mechanism to the second position, wherein the sleeve permits the flapper valve to close to hydraulically isolate the portion of the wellbore tubular;

engaging the latching mechanism to a piston, wherein the piston is releasably connected to the wellbore tubular by a shearable device adapted to shear under a predetermined amount of pressure;

increasing the pressure within the wellbore tubular to the predetermined amount to shear the shearable device;

the pressure moving the sleeve down the wellbore tubular to break the flapper valve.

8. The method of claim 7 wherein the latching mechanism is a spring loaded dog, a snap ring, or a collet.

9. The method of claim 7 further comprising engaging the sleeve with a second latching mechanism after breaking the flapper valve.

10. The method of claim 7 further comprising pumping hydraulic pressure into a hydraulic port in the wellbore tubular to back pressure the piston.

* * * * *